US005321478A

United States Patent [19]

Nakamura et al.

[11] Patent Number: 5,321,478

[45] Date of Patent: Jun. 14, 1994

[54] IMAGE FORMING APPARATUS WHICH CAN DISCRIMINATE FREQUENCY OF IMAGE FORMING OPERATIONS

[75] Inventors: Akihiro Nakamura, Kawasaki; Junichi Kimizuka, Yokohama; Takeji Gima; Toshiyuki Itoh, both of Toride, all of Japan

[73] Assignee: Canon Kabushiki Kaisha, Tokyo, Japan

[21] Appl. No.: 36,242

[22] Filed: Mar. 24, 1993

[30] Foreign Application Priority Data

Mar. 31, 1992 [JP] Japan ..... 4-104017

[51] Int. Cl.[5] ..... G03G 15/20

[52] U.S. Cl. ..... 355/285; 219/216; 355/204; 355/208; 355/289

[58] Field of Search ..... 355/203, 204, 208, 285, 355/289, 290, 206; 219/216, 388; 432/60; 118/60

[56] References Cited

U.S. PATENT DOCUMENTS 3,851,144 11/1974 Hutner ..... 219/216
3,916,146 10/1975 Hutner ..... 219/216
4,006,985 2/1977 Hutner ..... 219/216 X
5,241,349 8/1993 Nagasaka ..... 355/285

FOREIGN PATENT DOCUMENTS 0289863 11/1990 Japan .

*Primary Examiner*—Matthew S. Smith
*Attorney, Agent, or Firm*—Fitzpatrick, Cella, Harper & Scinto

[57] ABSTRACT

An image forming apparatus includes an image forming unit for forming an undeveloped image on a recording material, heating fixing unit for fixing the undeveloped image on the recording material by heating. The heating fixing unit includes a heating member heated by a heater, a temperature detector for detecting a temperature of the heating member, and a current-supply control unit for controlling current supply to the heater so that the temperature detected by the temperature detector is maintained at a predetermined control temperature in a standby state. The apparatus further includes an electric-power reduction unit for reducing or cutting electric power supplied to the heater when an image forming signal is not input for a predetermined time period after the completion of an image forming operation, and a discriminating unit for discriminating the frequency of image forming operations. The electric power reduction unit sets the predetermined time period variably in accordance with frequency of image forming operations discriminated by the discriminating unit.

10 Claims, 18 Drawing Sheets

FIG.10

| RESULT OF LEARNING FOR FREQUENCY OF PRINTING OPERATIONS P(24) | SET TIME FOR TIME |
|---|---|
| EQUAL TO AT LEAST 0 AND LESS THAN 2 | 1 MINUTE |
| EQUAL TO AT LEAST 2 AND LESS THAN 5 | 8 MINUTES |
| EQUAL TO AT LEAST 5 | 15 MINUTES |

FIG.13

| DAY OF WEEK | RESULT OF LEARNING | SET TIME FOR TIME |
|---|---|---|
| HOLIDAY | ANY NUMBERS | 1 MINUTE |
| WEEK DAY | EQUAL TO AT LEAST 0 AND LESS THAN 2 | 1 MINUTE |
| | EQUAL TO AT LEAST 2 AND LESS THAN 5 | 8 MINUTES |
| | EQUAL TO AT LEAST 5 | 15 MINUTES |

IMAGE FORMING APPARATUS WHICH CAN DISCRIMINATE FREQUENCY OF IMAGE FORMING OPERATIONS

BACKGROUND OF THE INVENTION

1. Field of the Invention

This invention relates to an image forming apparatus, such as an electrophotographic apparatus, an electrostatic recording apparatus or the like, and more particularly, to an image forming apparatus which includes heating fixing means.

2. Description of the Related Art

In general, an image forming apparatus, such as an electrophotographic copier or the like, includes an image forming station for forming a latent image corresponding to an original image and visualizing the latent image as a toner image, a transfer unit for transferring the toner image formed by the image forming station onto a transfer material, and a fixing unit for fixing the toner image transferred on the transfer material as a permanent image.

Heat-roller-type devices are used as the fixing devices. The heat-roller-type fixing device includes a fixing roller, and a pressing roller which rotates in pressure contact with the fixing roller to form a nip for conveying a transfer material while pressing it in cooperation with the fixing roller.

The fixing roller incorporates a heater for heating the surface of the roller to a predetermined temperature. The heating operation for the heater is controlled by a temperature control unit. Control temperatures corresponding to respective modes, i.e., a warm-up mode, a standby mode and a copying mode (or an image forming mode), are set in the temperature control unit. The control temperature in the warm-up mode corresponds to a fixing temperature at which the fixing roller can perform a fixing operation. The control temperature in the standby mode is set to a standby temperature which is slightly lower than the fixing temperature. The control temperature in the image forming mode is set to the fixing temperature. The temperature control unit performs on-off control of current supply to the heater so that the surface temperature of the fixing roller equals the control temperature while comparing the surface temperature of the fixing roller detected by a temperature detector with the control temperature.

In a standby state, current supply to the heater is intermittently performed for maintaining the surface temperature of the fixing roller at the standby temperature. Hence, when the accumulated standby time period is long, that is, when the frequency of image forming operations is small, electric power used for maintaining the surface temperature of the fixing roller at the standby temperature increases, causing an increase in economic burden on the user.

In order to reduce electric power consumption in a standby state, an approach may be considered in which the standby temperature in the standby mode is set to a lower temperature. In such an approach, however, much time is needed until the surface temperature of the fixing roller reaches the fixing temperature when the mode is switched from the standby mode to the image forming mode, causing an increase in a waiting time for the user until an image forming operation is completed.

In other approaches, the control temperature is reduced or current supply to the heater is interrupted if the subsequent image forming operation is not performed for a predetermined time period from the completion of an image forming operation. In such approaches, however, an appropriate time period cannot be set for each of various frequencies of the use.

SUMMARY OF THE INVENTION

It is an object of the present invention to provide an image forming apparatus which can reduce electric power consumption in a standby state and which can promptly move to an image forming mode.

It is another object of the present invention to provide an image forming apparatus which can change its power saving state in accordance with the frequency of image forming operations by the user.

According to one aspect, the present invention which achieve these objectives relates to an image forming apparatus comprising: (i) image forming means for forming a non-fixed image on a recording material; (ii) heat fixing means for fixing the non-fixed image on the recording material by heating, said heat fixing means comprising a heating member heated by a heater, a temperature detection member for detecting a temperature of said heating member, and electric power-supply control means for controlling electric power supply to the heater so that the temperature detected by said temperature detection member is maintained at a predetermined control temperature in a standby state; (iii) electric-power reduction means for reducing or shutting electric power supply to the heater when an image forming signal is not input for a predetermined time period after the completion of an image forming operation; and (iv) discriminating means for discriminating the frequency of image forming operations, wherein said electric-power reduction means sets the predetermined time period variably in accordance with the frequency of image forming operations discriminated by said discriminating means.

The electric-power reduction means can lower the control temperature when an image forming signal is not input for the predetermined time period after the completion of the image forming operation. Additionally, the electric-power reduction means may increase the predetermined time period when the frequency of image forming operations determined by the discriminating means has a large value. The image forming apparatus of this aspect of the invention may further comprise resuming means for resuming temperature control for the heating member for image formation when an image forming signal has been input in an electric-power reducing mode by the electric-power reduction means.

The discriminating means of this invention may comprise a timer for measuring time, and a counter for counting the number of image forming operations. In addition, the discriminating means may comprise a memory for storing the frequency of image forming operations, wherein data stored in the memory is periodically updated.

According to another aspect, the present invention which achieves these objectives relates to an image forming apparatus comprising: (i) image forming means for forming a non-fixed image on a recording material; (ii) heat fixing means for fixing the non-fixed image on the recording material by heating, said heat fixing means comprising a heating member heated by a heater, a temperature detection member for detecting a temperature of said heating member, and electric power supply to the heat so that the temperature detected by said temperature detection member is maintained at a predetermined control temperature in a standby state; (iii) temperature control means for lowering the control temperature when an image forming signal is not input for a predetermined time period after the completion of an image forming operation; and (iv) discriminating means for discriminating the frequency of image forming operations, wherein said temperature control means determines the control temperature in accordance with the frequency of image forming operations discriminated by said discriminating means.

This aspect of the invention may further comprise resuming means for resuming temperature control for image forming when an image forming signal has been input in a lower temperature control state by the temperature control means. Additionally, the temperature control means may reduce the rate of reduction of the control temperature when the frequency of the image forming means has a large value.

The forgoing and other objects, advantages and features of the present invention will become more apparent from the following description of the preferred embodiments taken in conjunction with the accompanying drawings.

BRIEF DESCRIPTION OF THE DRAWINGS

FIG. 10 is a diagram showing the contents of a table in which the relationship between the result of learning for the frequency of printing operations and the set time for a timer in the image forming apparatus shown in FIG. 1 is described;

FIG. 13 is a diagram showing the contents of a table in which the relationship among the result of learning for the frequency of printing operations, days of week set by a calendar IC (integrated circuit), and the set time for a timer in the image forming apparatus shown in FIG. 11 is described;

DESCRIPTION OF THE PREFERRED EMBODIMENTS

Preferred embodiments of the present invention will now be described with reference to the drawings.

Figure 1:
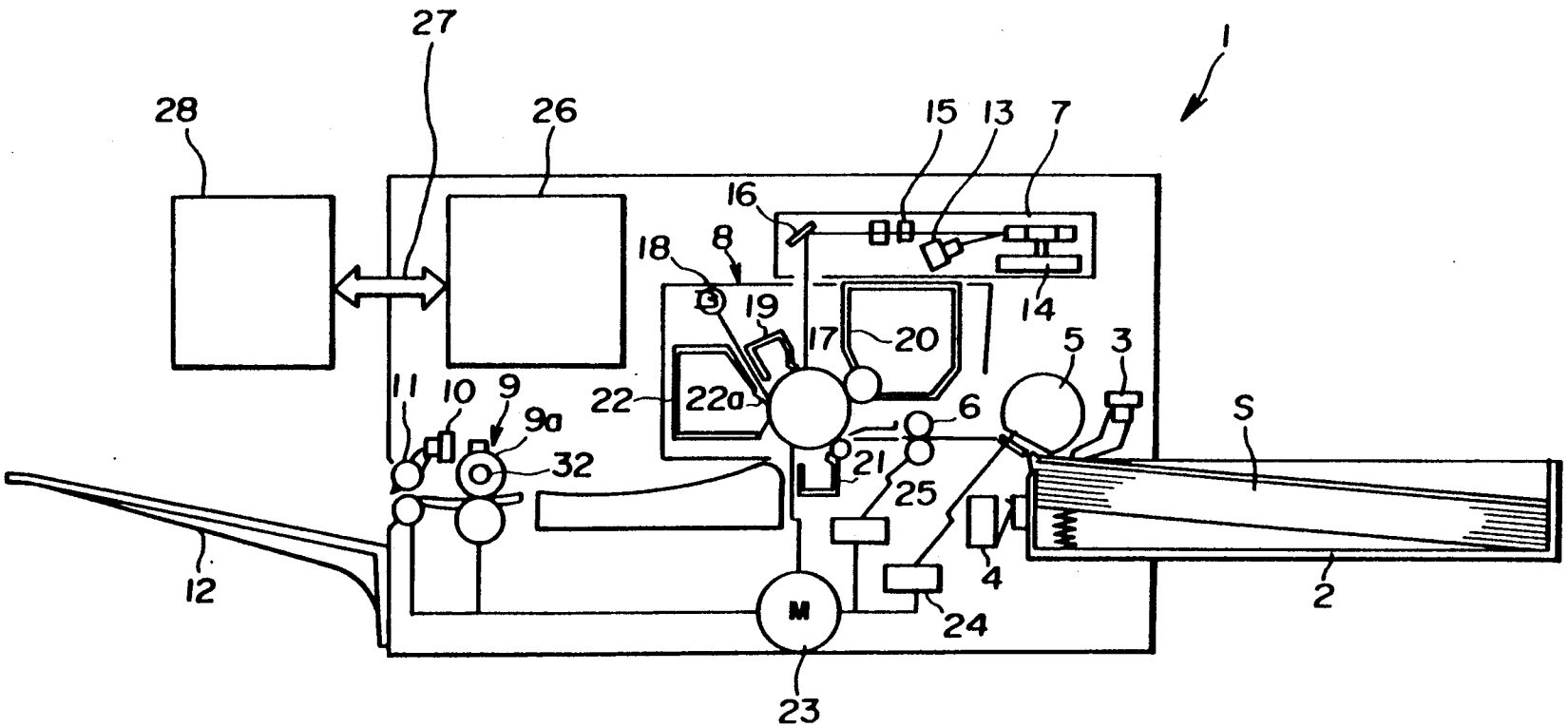
FIG. 1 is a cross-sectional view of an image forming apparatus according to an embodiment of the present invention.

FIG. 1 is a cross-sectional view of an image forming apparatus according to an embodiment of the present invention.

As shown in FIG. 1, laser-beam printer 1, serving as an image forming apparatus, includes sheet-feeding cassette 2 for accommodating sheets of recording paper S. Cassette-sheet sensor 3 for detecting the presence of recording paper S within sheet-feeding cassette 2, cassette-size sensor (comprising a plurality of microswitches) 4 for detecting the size of recording paper S within sheet-feeding cassette 2, and sheet-feeding roller 5 for feeding recording paper S from within sheet-feeding cassette 2 are provided around sheet-feeding cassette 2.

A pair of registration rollers 6 for conveying recording paper S in a synchronized state are disposed at a portion downstream from sheet-feeding roller 5. Image forming unit 8 for forming a toner image on recording paper S using laser light from laser scanner unit 7 is disposed at a portion downstream from the pair of registration rollers 6. Fixing unit 9 for fixing the toner image on recording paper S by heat is disposed at a portion downstream from image forming unit 8. Sheet-discharge sensor 10 for detecting a conveying state of recording paper S by sheet-discharging rollers 11, and mounting tray 12 for mounting recording paper S on which image formation has been completed are disposed at portions downstream from fixing unit 9.

Laser scanner unit 7 includes laser unit 13 for emitting laser light modulated in accordance with an image signal (a VDO signal) transmitted from external apparatus 28 (to be described later), polygonal-mirror motor 14 for scanning the surface of photosensitive drum 17 (to be described below) with the laser light from laser unit 13, a group of imaging lenses 15, and reflecting mirror 16.

Image forming unit 8 includes photosensitive drum 17, preexposure lamp 18, primary charger 19, developing unit 20, transfer charger 21, and cleaner 22 having cleaner blade 22a.

The driving force of main motor 23 is supplied to sheet-feeding roller 5 and the pair of registration rollers 6 via sheet-feeding-roller clutch 24 and registration-roller clutch 25, respectively.

The driving force of main motor 23 is supplied to the respective units of image forming unit including photosensitive drum 17, to fixing unit 9, and to sheet-discharging rollers 11.

Figure 2:
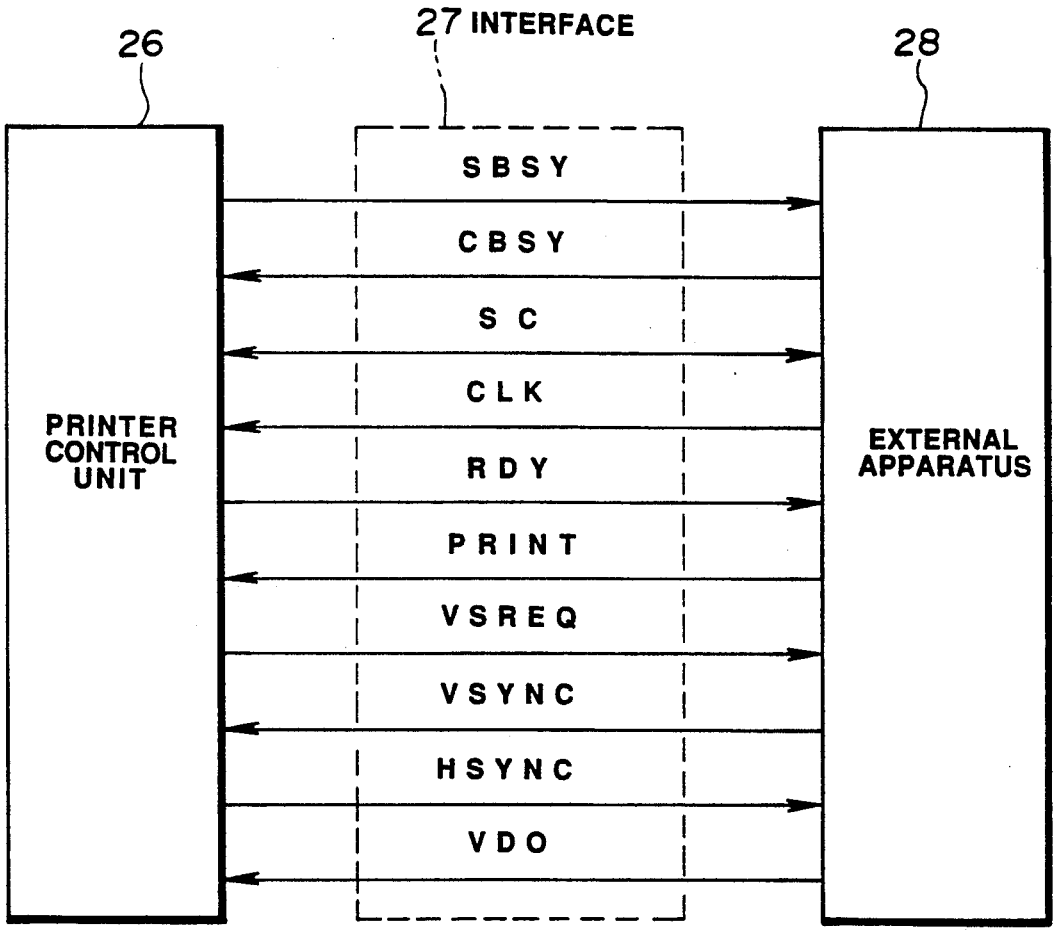
FIG. 2 is a diagram showing the configuration of an interface with an external apparatus in the image forming apparatus shown in FIG. 1.

The above-described respective units are controlled by printer control unit 26. As shown in FIG. 2, printer control unit 26 is connected to external apparatus 28 via interface 27 so as to be able to transmit and receive signals.

As shown in FIG. 2, signals transmitted from printer control unit 26 to external apparatus 28 includes SBSY signal, RDY signal, VSREQ signal and HSYNC signal. Signals transmitted from external apparatus 28 to printer control unit 26 includes CBSY signal, CLK signal, PRINT signal, VSYNC signal and VDO signal.

The SBSY signal is a status effective signal, and the CBSY signal is a command effective signal. When the SBSY signal is "TRUE", an SC signal, serving as a status/command signal, is transmitted from printer control unit 26 to external apparatus 28 as status data indicating the internal state of the printer. When the CBSY signal is "TRUE", an SC signal is transmitted from external apparatus 28 to printer control unit 26 as command data indicating a command for the printer.

The CLK signal is a synchronizing clock signal for the SC signal. Printer control unit 26 sends back for one command from external apparatus 28 one status corresponding to the command. Each of the above-described SBSY signal, CBSY signal and CLK signal is a signal used in handshaking-type serial communication.

The RDY signal is a ready signal, which becomes "TRUE" when printer control unit 26 is in a printable state. The PRINT signal is a printing signal, which becomes "TRUE" when external apparatus 28 instructs the start of a printing operation.

The VSREQ signal is a vertical-synchronizing-signal requesting signal for requesting the output of a VSYNC signal from printer control unit 26 to external apparatus 28. The VSYNC signal is a vertical synchronizing signal transmitted from external apparatus 28 to printer control unit 26 in order to synchronize the vertical direction (the sub-scanning direction or the sheet feeding direction) of an image output. The HSYNC signal is a horizontal synchronizing signal transmitted from external apparatus 28 to printer control unit 26 in order to synchronize the horizontal direction (the main-scanning direction or the direction of laser scanning) of an image output. The VDO signal is an image signal transmitted from external apparatus 28 to printer control unit 26 in order to synchronize the VSYNC signal with the HSYNC signal for serially transmitted dot images.

Printer control unit 26 incorporates halogen-lamp-heater driving circuitry (shown in FIG. 6), serving as temperature control means for performing temperature control processing in raising the surface temperature of fixing roller 9a to a fixing temperature by controlling current supply to halogen-lamp heater 32, learning means (not shown) for learning the frequency of transmission of VDO signals based on PRINT signals supplied from external apparatus 28, stoppage means (not shown) for stopping the temperature control processing of the halogen-lamp-heater driving circuitry in accordance with the frequency of transmission indicated by the result of learning of the learning means, and resuming means (not shown ) for resuming the temperature control processing of the halogen-lamp-heater driving circuitry when a PRINT signal is supplied from external apparatus 28 while the temperature control processing of the halogen-lamp-heater driving circuitry stops.

Figure 3:
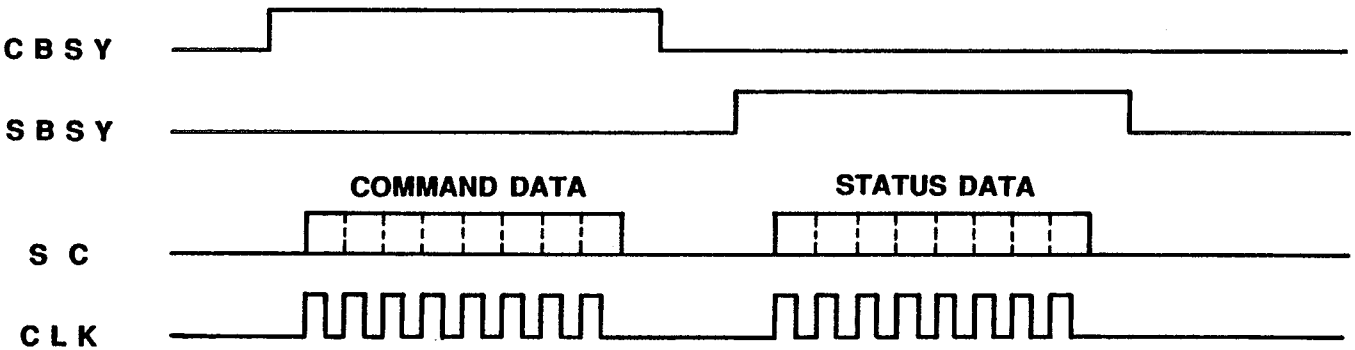
FIG.3 is a first timing chart illustrating the image forming processing of the image forming apparatus shown in FIG. 1.
Figure 4:
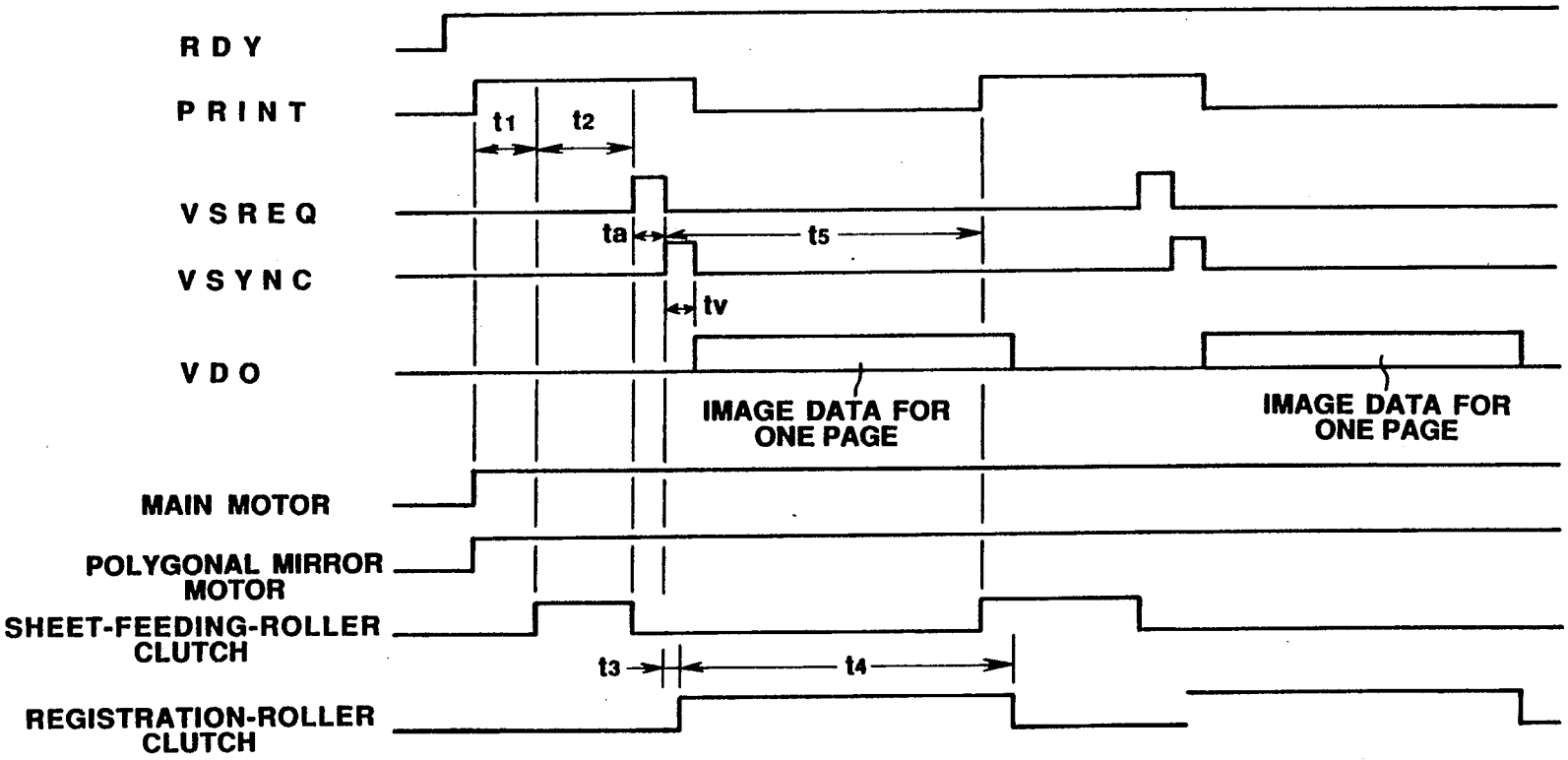
FIG. 4 is a second timing chart illustrating the image forming processing of the image forming apparatus shown in FIG. 1.
Figure 5:
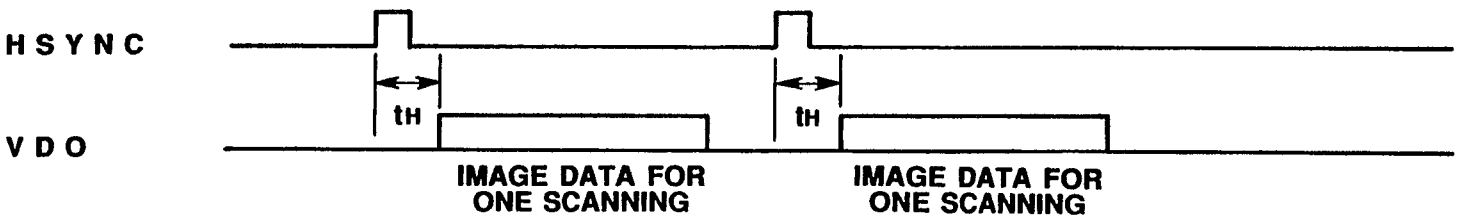
FIG. 5 is a third timing chart illustrating the image forming processing of the image forming apparatus shown in FIG. 1.

Next, a description will be provided of the image forming processing of the image forming apparatus with reference to FIGS. 3 through 5. FIG. 3 is a first timing chart illustrating the image forming processing of the image forming apparatus shown in FIG. 1. FIG. 4 is a second timing chart illustrating the image forming processing of the image forming apparatus shown in FIG. 1. FIG. 5 is a third timing chart illustrating the image forming processing of the image forming apparatus shown in FIG. 1.

When the PRINT signal becomes "TRUE", printer control unit 26 starts the drive of main motor 23 and polygonal-mirror motor 14.

In accordance with the start of the drive of main motor 23, photosensitive drum 17, fixing roller 9a and sheet-discharging roller 11 start to rotate. At substantially the same time, the drive of first charger 19, developing unit 20 and transfer charger 21 is started. When the rotation of polygonal-mirror motor 14 becomes in a steady state, printer control unit 26 connects sheet-feeding-roller clutch 24 to drive sheet-feeding roller 5. In accordance with the drive of sheet-feeding-roller 5, recording paper S is conveyed toward the pair of registration rollers 6.

Thereafter printer control unit 26 transmit a VSREQ signal to external apparatus 28 with the timing ($t_2$ seconds after the start of the drive of sheet-feeding roller 5) that the leading end of recording paper S reaches the pair of registration rollers 6, and disconnects sheet-feeding-roller clutch 24. In accordance with the disconnection of sheet-feeding-roller clutch 24, the drive of sheet-feeding roller 5 is stopped.

When external apparatus 28 has completed development of image information into a dot image and the preparation of the output of a VDO signal, external apparatus 28 confirms that the VSREQ signal is "TRUE", sets the VSYNC signal to "TRUE", and starts to output a VDO signal for one page after $t_v$ seconds in synchronization therewith.

After $t_3$ seconds from the rise of the VSYNC signal, printer control unit 26 connects registration-roller clutch 25. The pair of registration rollers 6 are driven by the connection of registration clutch 25. The drive of the pair of registration rollers 6 is performed for $t_4$ seconds until the rear end of recording paper S passes through the pair of registration rollers 6.

During the drive of the pair of registration rollers 6, printer control unit 26 transmits an HSYNC signal to external apparatus 28 in synchronization with laser scanning with a predetermined timing, and modulates the laser light emitted from laser unit 13 based on the VDO signal. As shown in FIG. 5, external apparatus 28 outputs the VDO signal for one scanning in synchronization with the HSYNC signal.

In the next printing operation, the PRINT signal is set again to "TRUE" after $t_5$ seconds, and the same processing as for the first sheet is performed.

By the above-described operations of printer control unit 26 and external apparatus 28, recording paper S is sequentially conveyed to sheet-feeding roller 5, the pair of registration rollers 6, image forming unit 8, fixing unit 9 and sheet-discharging roller 11, and an image is formed on recording paper S.

Figure 6:
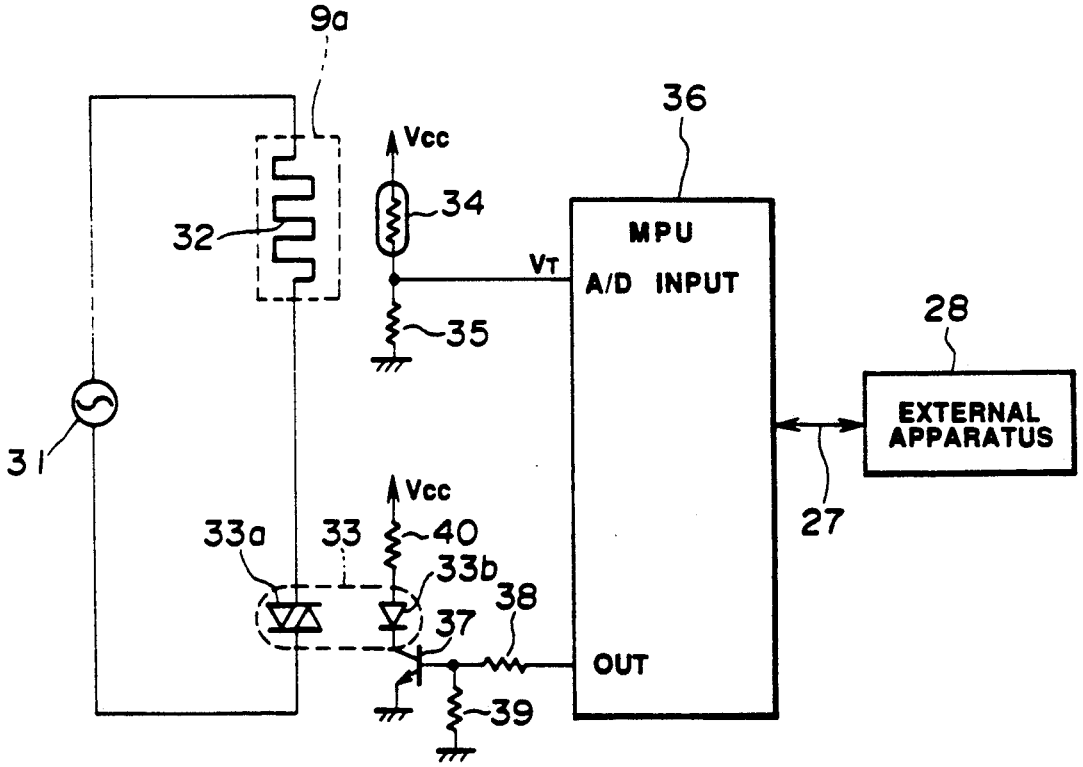
FIG. 6 is a block diagram illustrating driving circuitry for a halogen-lamp heater used in the image forming apparatus shown in FIG. 1.
Figure 7:
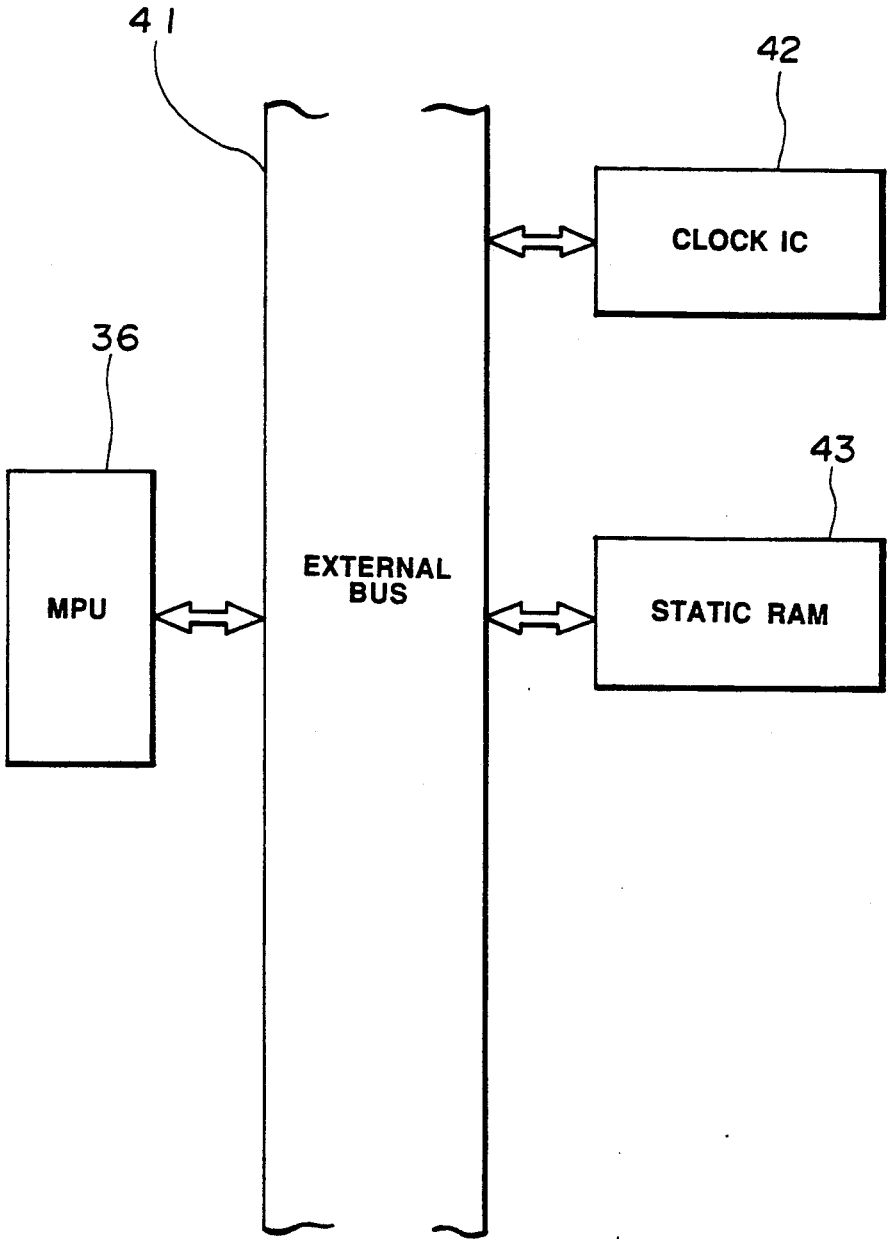
FIG. 7 is a block diagram illustrating peripheral circuitry for MPU 36 used in the image forming apparatus shown in FIG. 1.

Next, a description will be provided of temperature control for fixing roller 9a of fixing unit 9 with reference to FIGS. 1, 6 and 7. FIG. 6 is a block diagram illustrating driving circuitry for the halogen-lamp heater used in the image forming apparatus shown in FIG. 1. FIG. 7 is a block diagram illustrating peripheral circuitry for MPU 36.

Temperature control for fixing roller 9a is performed by controlling current supply to halogen-lamp heater 32 while monitoring the temperature of fixing roller 9a. The control of current supply for halogen-lamp heater 32 is performed by driving circuitry for halogen-lamp heater 32 provided in printer unit 26. As shown in FIG. 6, the driving circuitry for halogen-lamp heater 32 includes solid-state relay (SSR) 33 for controlling zero crossing of AC voltage supplied from AC power supply 31 to halogen-lamp heater 32. Solid-state relay 33 includes Triac 33a and photosensor 33b.

The surface temperature of fixing roller 9a is detected by thermistor 34. Analog voltage $V_T$ determined by the resistance values of thermistor 34 and resistor 35 is applied to an A/D conversion input port of MPU 36, and information with respect to the temperature of fixing roller 9a corresponding to the A/D conversion level is transmitted to MPU 36. MPU 36 comprises a microprocessor for controlling the driving operations of respective units, such as the driving operation of main motor 23, the connecting/disconnecting operation of sheet-feeding-roller clutch 24, the connecting/disconnecting operation of registration-roller clutch 25, and the like. A μCOM87AD (trade name of a product made by NEC) is used as the microprocessor.

Output port OUT of MPU 36 is connected to the base of transistor 37 and one end of resistor 39 via resistor 38. The other end resistor 39 is grounded.

The emitter of transistor 37 is grounded, and the collector of transistor 37 is connected to the cathode of photosensor 33b. The anode of photosensor 33b is connected to one end of resistor 40. A DC power supply (supplying voltage $V_{cc}$) is connected to the other end of resistor 40.

Halogen-lamp heater 32 is turned on when the signal output from the output port of MPU 36 assumes an H level, and is turned off when the signal output from the output port of MPU 36 assumes an L level. That is, MPU 36 monitors analog voltage $V_T$ corresponding to the surface temperature of fixing roller 9a and changes the level of output port OUT, whereby temperature control for fixing roller 9a is performed.

Clock IC (integrated circuit) 42 and static RAM 43 are disposed around MPU 36, and are connected to MPU 36 via external bus 41.

Figure 8:
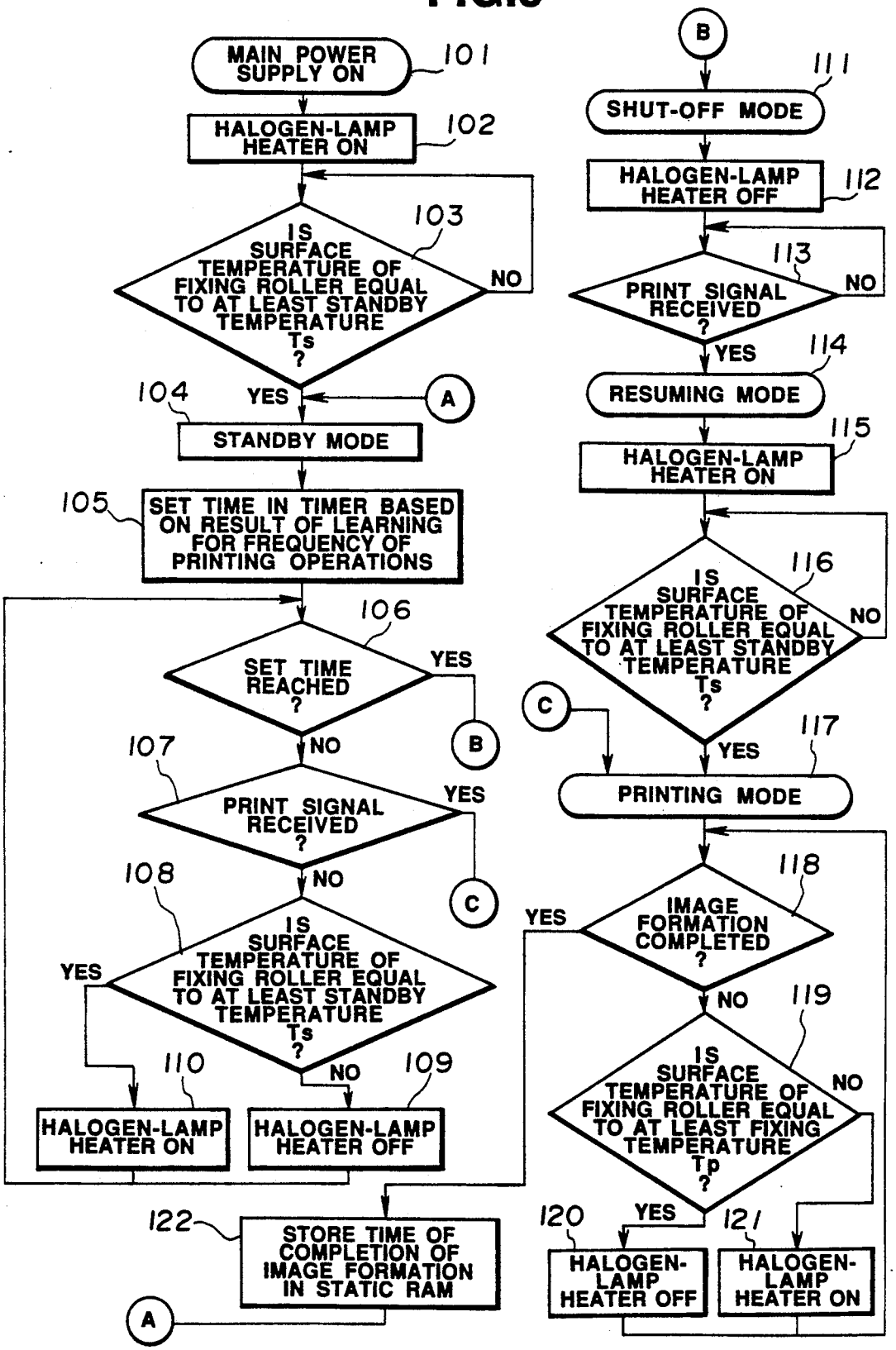
FIG. 8 is a flowchart illustrating temperature control processing for a fixing roller of a fixing unit provided in the image forming apparatus shown in FIG. 1.
Figure 9:
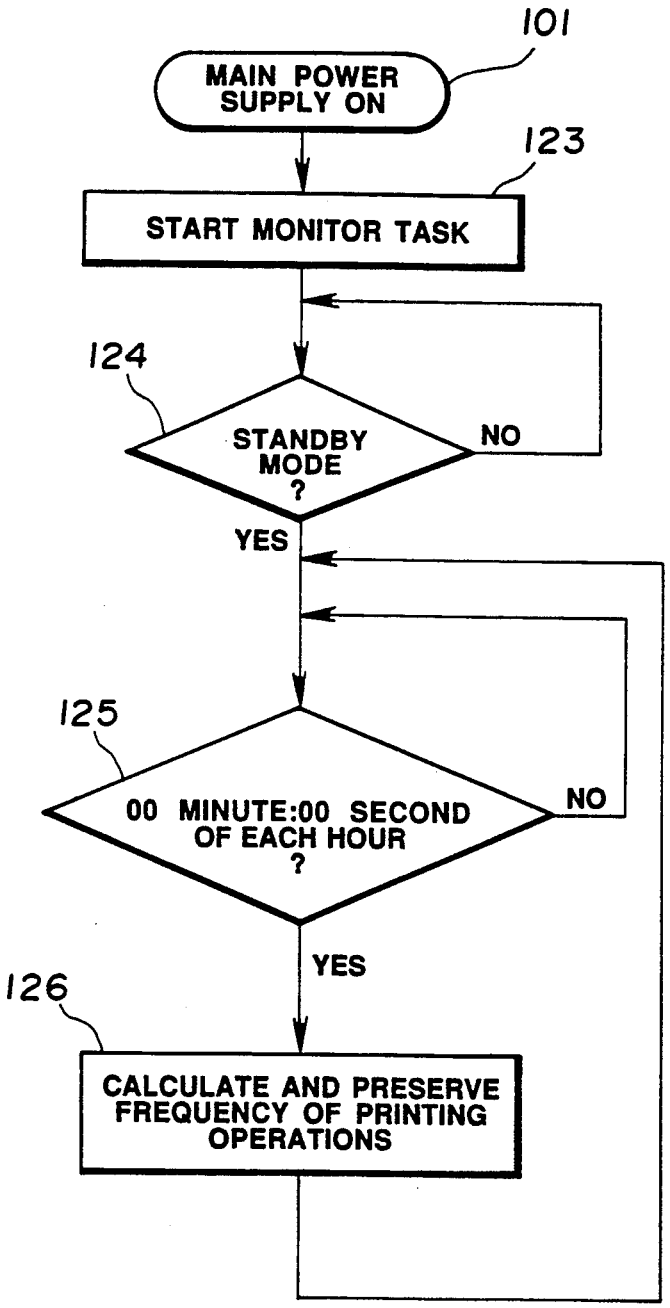
FIG. 9 is a flowchart illustrating the operation of a continuous monitor task for the image forming apparatus shown in FIG. 1.

Next, a description will be provided of temperature control processing for fixing roller 9a of fixing unit 9 with reference to FIG. 8. FIG. 8 is a flowchart illustrating temperature control processing for fixing roller 9a of fixing unit 9 provided in the image forming apparatus shown in FIG. 1. FIG. 9 is a flowchart illustrating the operation of a continuous monitor task for the image forming apparatus shown in FIG. 1. FIG. 10 is a diagram showing the contents of a table in which the relationship between the result of learning for the frequency of printing operations, and the set time for a timer in the image forming apparatus is described.

When the main power supply is turned on (step 101), a warm-up mode is first executed. In the warm-up mode, halogen-lamp 32 is turned on (step 102), and heating of fixing roller 9a by halogen-lamp heater 32 is performed. When the surface temperature of fixing roller 9a has reached a standby temperature (step 103), a standby mode is executed (step 104).

In the standby mode, a duration determined from the frequency of printing operations indicated by the result of learning by the learning means is set in the timer (step 105), and the measurement of time by the timer is started. Monitoring of the time measured by the timer (step 106), monitoring of the reception of a PRINT signal (step 107) and monitoring of the surface temperature of fixing roller 9a (step 108) are performed. By controlling current supply to halogen-lamp heater 32 (steps 109 and 110), the surface temperature of fixing roller 9a is maintained at the preset standby temperature.

If a PRINT signal is received before the time measured by the timer reaches the duration (step 107, the mode is switched to a printing mode (step 117).

When the time measured by the timer has reached the duration (step 106), the mode is switched from the standby mode to a shut-off mode (step 111). In the shut-off mode, halogen-lamp heater 32 is turned off (step 112). The turned-Off state of halogen-lamp heater 32 is continued until a PRINT signal is received (step 113).

When a PRINT signal has been received (step 113), the mode is switched from the shut-off mode to a resuming mode (step 114). In the resuming mode, halogen-lamp heater 32 is turned on (step 115). After the surface temperature of fixing roller 9a has reached at least the standby temperature, the mode is switched to a printing mode (steps 116 and 117).

When the mode has been switched from the standby mode or the resuming mode to the printing mode (step 117), image forming processing for forming an image on recording paper S is performed.

The surface temperature of fixing roller 9a is maintained at the fixing temperature by controlling current supply to halogen-lamp heater 32 until the image forming processing is completed (steps 118 through 121).

When the image forming processing has been completed (step 118), the time when the image forming processing has been completed is stored in static RAM 43 (step 122), and the standby mode is executed again.

In addition to the sequence of the above-described image forming processing, a continuous monitor task for calculating the frequency of printing operations and preserving the result of the calculation is started. The continuous monitor task by calculating the frequency of printing operations and preserving the result of the calculations provides a means for discriminating the frequency of the image forming operation.

As shown in FIG. 9, the continuous monitor task is started (step 123) immediately after the main power supply has been turned on (step 101). If the standby mode is executed (step 124), monitoring of time is started (step 125). The calculation of the frequency of printing operations and the preservation of the result of the calculation are performed at 00 minute and 00 second of each hour (step 126).

If the current time is represented by T (=0, 1,. . . , 23), and the number of printing operations from one hour before the current time until the current time is represented by $P_{now}$, the data $P(T-1)$ of the frequency of printing operations to be newly stored is obtained by the following expression (1):

$$P(T-1)=\{P(T-1)+P_{now}\}/2 \quad (1),$$

where P(T−1) at the left side represents data of the frequency of printing operations to be newly stored, and P(T−1) at the right side represents data of the frequency of printing operations at the preceding time period.

The newly obtained data P(T−1) of the frequency of printing operations is stored in static RAM 43. The number of printing operations per hour is learned from data P(T−1), and the above-described set time for the timer is determined from the result of the learning.

For example, if the result of learning for the frequency of printing operations indicates a numerical value of at least 0 and less than 2, the set time for the timer is 1 minute, as shown in FIG. 10. If the result of learning for the frequency of printing operations indicates a numerical value of at least 2 and less than 5, the set time for the timer is 8 minutes. If the result of learning for the frequency of printing operations indicates a numerical value of at least 5, the set time for the timer is 15 minutes. It is apparent that a computer program can readily be designed by one skilled in the art of calculating the frequency of printing operations, storing the calculated values and setting the duration of time for the standby mode based on the learned frequency of printing operations.

As described above, the temperature control processing by the driving circuitry for the halogen-lamp heater is stopped in accordance with the result of learning for the frequency of transmission of PRINT signals from external apparatus 28, Hence, the amount of electric power consumed by halogen-lamp heater 32 can be reduced, while the time needed for raising the surface temperature of fixing roller 9*a* to the fixing temperature does not increase.

Figure 11:
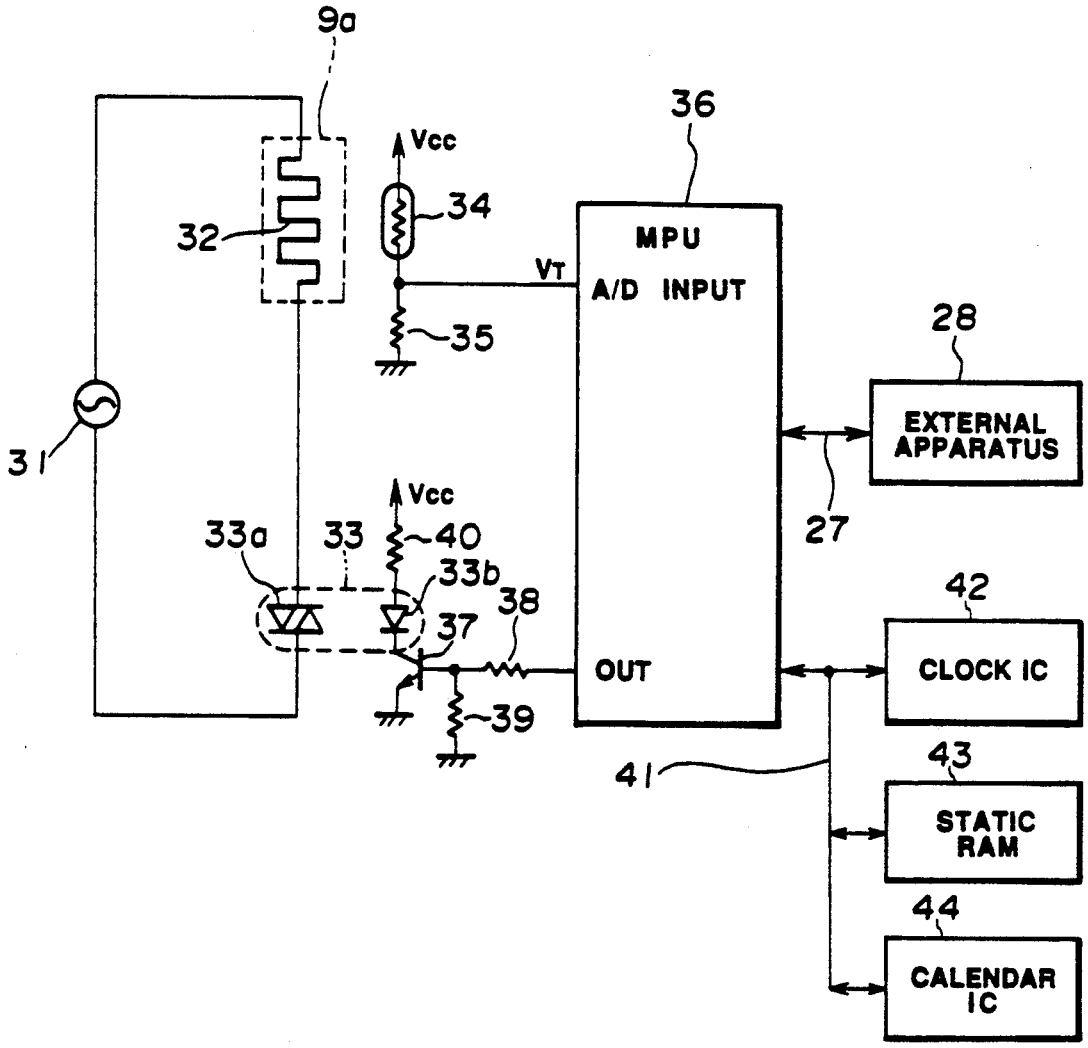
FIG. 11 is a block diagram illustrating driving circuitry for a halogen-lamp heater and peripheral circuitry for an MPU used in an image forming apparatus according to another embodiment of the present invention.
Figure 12:
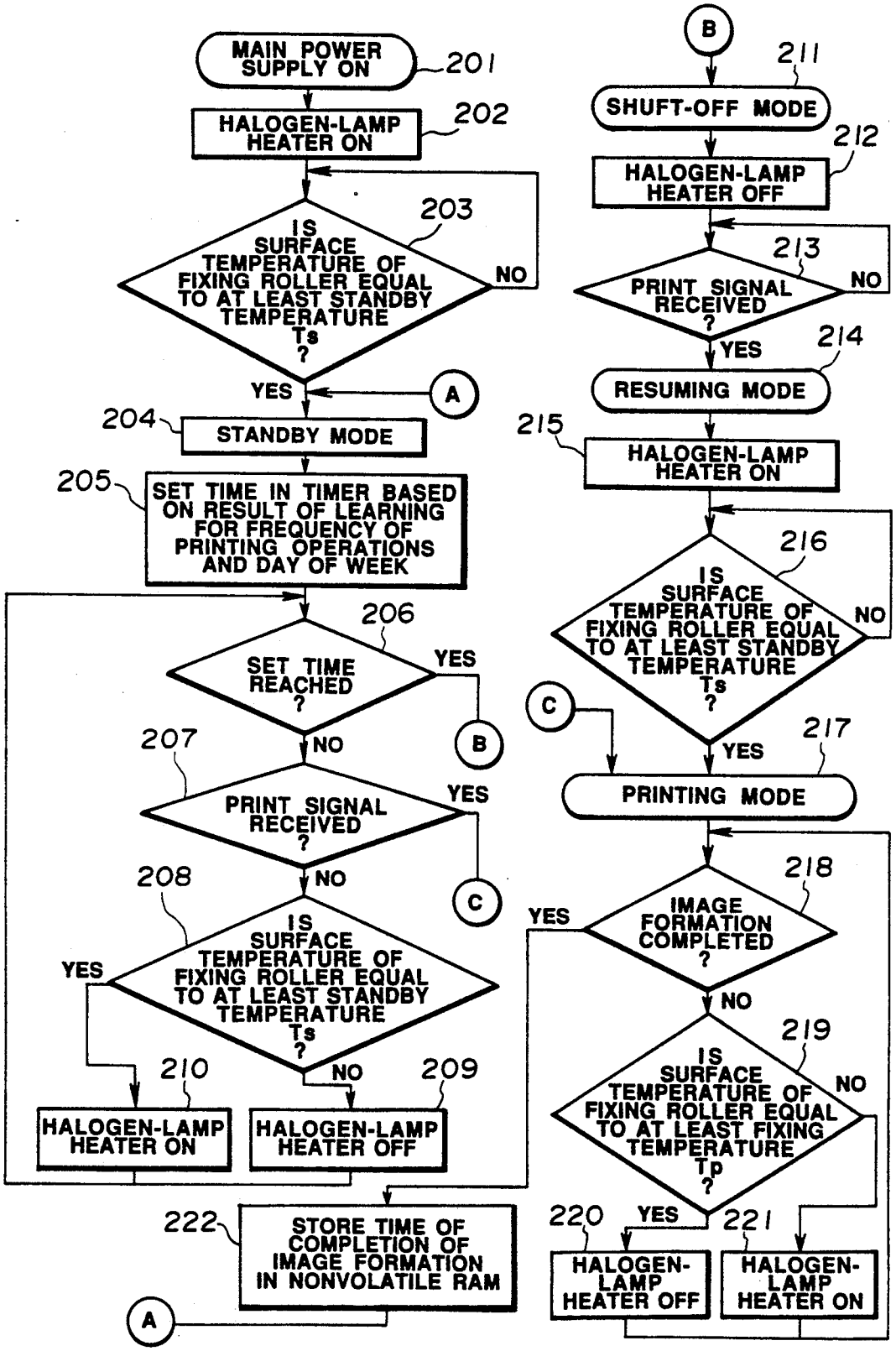
FIG. 12 is a flowchart illustrating temperature control processing for a fixing roller of the image forming apparatus shown in FIG. 11.

Next, a description will be provided of another embodiment of the present invention with reference to FIGS. 11 through 13.

FIG. 11 is a block diagram illustrating driving circuitry for a halogen-lamp heater and peripheral circuitry for an MPU of an image forming apparatus of the present embodiment. FIG. 12 is a flowchart illustrating temperature control processing for a fixing roller of the image forming apparatus. FIG. 13 is a diagram showing the contents of a table in which the relationship among the result of learning for the frequency of printing operations, days of week set by a calendar IC, and the set time for a timer in the image forming apparatus is described.

As shown in FIG. 11, a printer control unit of the apparatus incorporates halogen-lamp-heater driving circuitry, serving as temperature control means for performing temperature control processing in raising the surface temperature of fixing roller 9*a* to a fixing temperature by controlling current supply to halogen-lamp heater 32, learning means (not shown) for learning the frequency of transmission of VDO signals based on PRINT signals supplied from external apparatus 28 via interface 27, prediction means (not shown) for predicting a change in the frequency of transmission of PRINT signals based on PRINT signals supplied from external apparatus 28 to the printer control unit, and the current day of week, stoppage means (not shown) for stopping the temperature control processing of the halogen-lamp-heater driving circuitry in accordance with the frequency of transmission indicated by the result of learning of the learning means and the range of the change in the frequency of transmission indicated by the result of the prediction by the prediction means, and resuming means (not shown) for resuming the temperature control processing of the halogen-lamp-heater driving circuitry when a PRINT signal is supplied from external apparatus 28 while the temperature control processing of the halogen-lamp-heater driving circuitry stops.

The halogen-lamp-heater driving circuitry performs temperature control for fixing roller 9*a* by monitoring analog voltage $V_T$ corresponding to the surface temperature of fixing roller 9*a* and changing the level of output port OUT by MPU 36.

Clock IC 42, static RAM 43 and calendar IC 44 are disposed around MPU 36, and are connected to MPU 36 via external bus 41.

Next, a description will be provided of temperature control processing for fixing roller 9*a* with reference to FIG. 12.

When the main power supply is turned on (step 201), a warm-up mode is first executed. In the warm-up mode, halogen-lamp heater 32 is turned on (step 202), and heating of fixing roller 9*a* by halogen-lamp heater 32 is performed. When the surface temperature of fixing roller 9*a* has reached a standby temperature (step 203), a standby mode is executed (step 204).

In the standby mode, a duration determined from the frequency of printing operations indicated by the result of prediction by the prediction means is set in the timer (step 205), and the measurement of time by the timer is started. Monitoring of the time measured by the timer (step 206), monitoring of the reception of a PRINT signal (step 207) and monitoring of the surface temperature of fixing roller 9*a* (step 208) are performed. By controlling current supply to halogen-lamp heater 32 (steps 209 and 210), the surface temperature of fixing roller 9*a* is maintained at the preset standby temperature.

If a PRINT signal is received before the time measured by the timer reaches the duration (step 207, the mode is switched to a printing mode (step 217).

When the time measured by the timer has reached the duration (step 206), the mode is switched from the standby mode to a shut-off mode (step 211). In the shut-off mode, halogen-lamp heater 32 is turned off (step 212). The turned-off state of halogen-lamp heater 32 is continued until a PRINT signal is received (step 213).

When a PRINT signal has been received (step 213), the mode is switched from the shut-off mode to a resuming mode (step 214). In the resuming mode, halogen-lamp heater 32 is turned on (step 215). After the surface temperature of fixing roller 9*a* has reached at least the standby temperature, the mode is switched to a printing mode (steps 216 and 217).

When the mode has been switched from the standby mode or the resuming mode to the printing mode (step 217), image forming processing for forming an image on recording paper S is performed.

The surface temperature of fixing roller 9*a* is maintained at the fixing temperature by controlling current supply to halogen-lamp heater 32 until the image forming processing is completed (steps 218 through 221). When the image forming processing has been completed (step 218), the time when the image forming processing has been completed is stored in static RAM 43 (step 222), and the standby mode is executed again.

In addition to the sequence of the above-described image forming processing, a continuous monitor task is started. In the continuous monitor task, the frequency of printing operations is learned, and the set time for the timer is determined from the result of the learning and the current day of week.

For example, if the current day of week is a holiday, such as Sunday or the like, the set time for the timer is 1 minute irrespective of the numerical value of the result of learning, as shown in FIG. 13.

If the current day of week is a weekday, the set time for the timer is determined from the result of learning for the frequency of printing operations. If the result of learning for the frequency of printing operations indicates a numerical value of at least 0 and less than 2, the set time for the timer is 1 minute. If the result of learning for the frequency of printing operations indicates a numerical value of at least 2 and less than 5, the set time for the timer is 8 minutes. If the result of learning for the frequency of printing operations indicates a numerical value of at least 5, the set time for the timer is 15 minutes.

As described above, the temperature control processing by the halogen-lamp-heater driving circuitry is stopped in accordance with the result of learning for the frequency of transmission of PRINT signals from external apparatus 28. Hence, the amount of electric power consumed by halogen-lamp heater 32 can be reduced, while the time needed for raising the surface temperature of fixing roller 9a to the fixing temperature does not increase.

Figure 14:
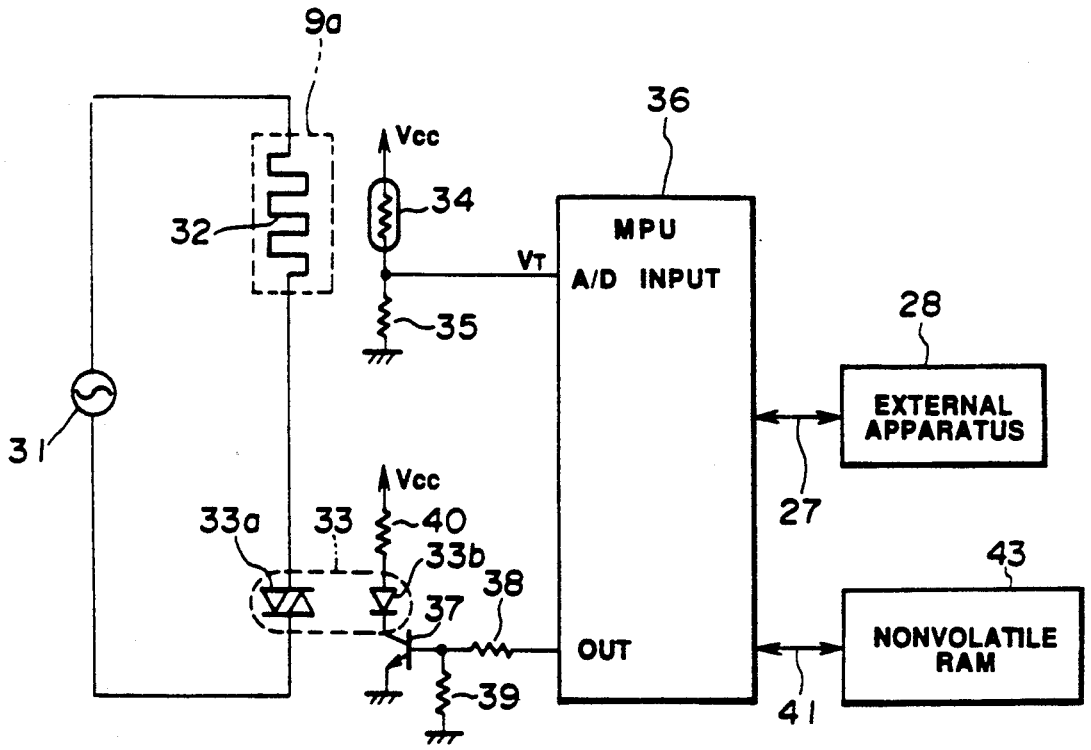
FIG. 14 is a block diagram illustrating driving circuitry for a halogen-lamp heater and peripheral circuitry for an MPU used in an image forming apparatus according to still another embodiment of the present invention.
Figure 15:
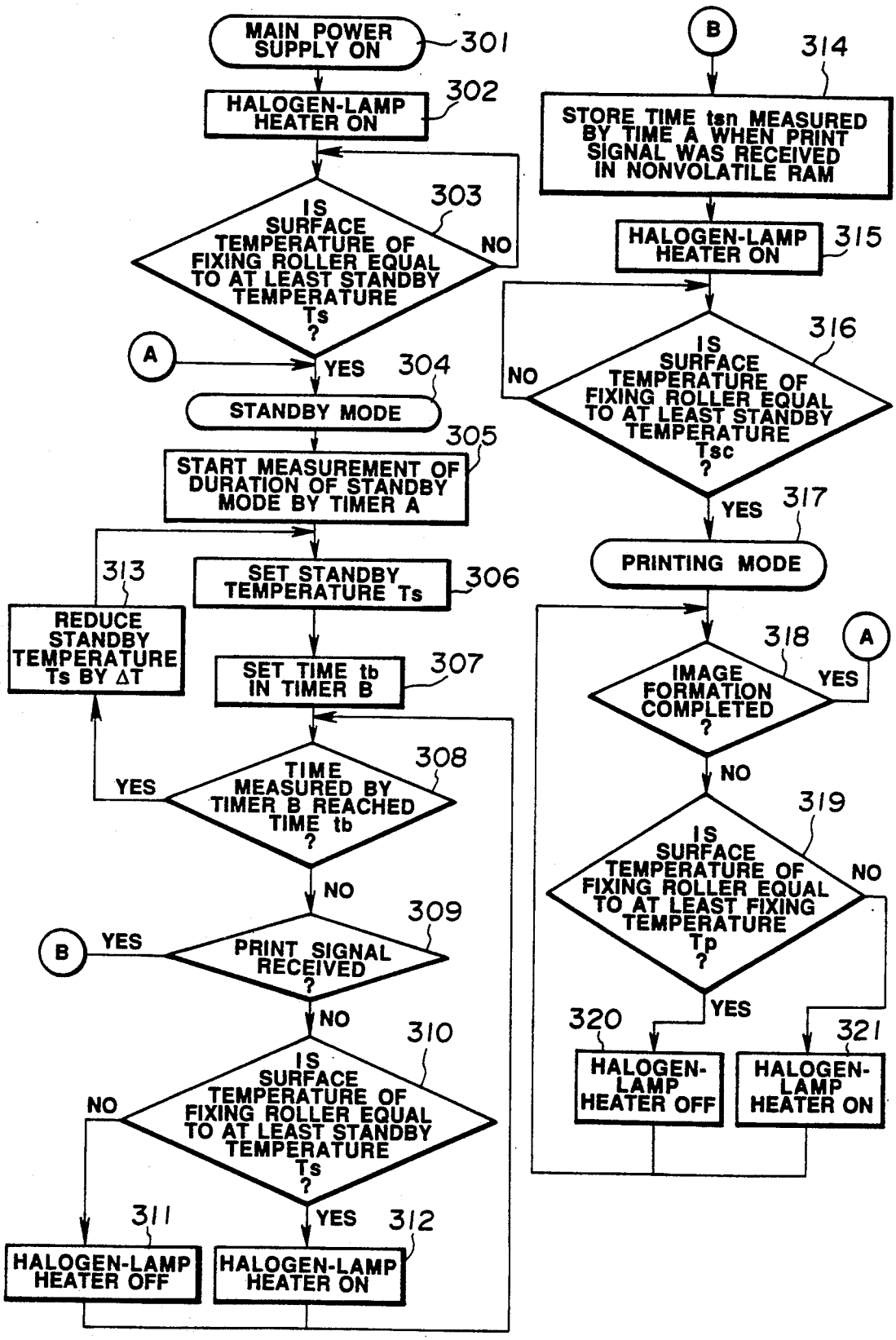
FIG. 15 is a flowchart illustrating temperature control processing for a fixing roller of the image forming apparatus shown in FIG. 14.
Figure 16:
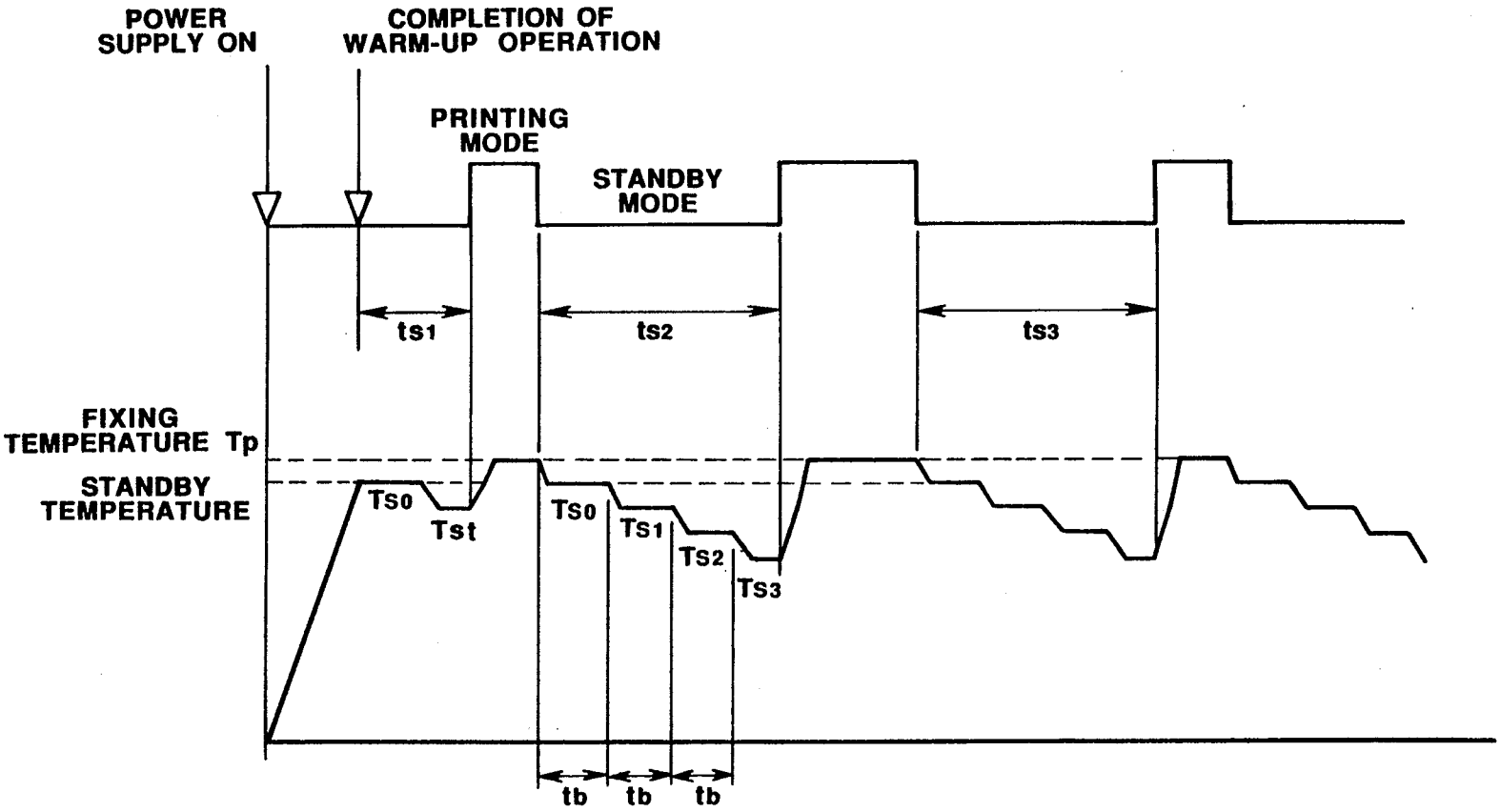
FIG. 16 is a time chart illustrating changes in the surface temperature of the fixing roller of the image forming apparatus shown in FIG. 14.

Next, a description will be provided of still another embodiment of the present invention with reference to FIGS. 14 through 16. FIG. 14 is a block diagram illustrating driving circuitry for a halogen-lamp heater and peripheral circuitry for an MPU used in an image forming apparatus of this embodiment. FIG. 15 is a flowchart illustrating temperature control processing for a fixing roller of the image forming apparatus. FIG. 16 is a time chart illustrating changes in the surface temperature of the fixing roller.

As shown in FIG. 14, a printer control unit of the image forming apparatus incorporates halogen-lamp-heater driving circuitry, serving as temperature control means for performing temperature control processing in raising the surface temperature of fixing roller 9a to a fixing temperature by controlling current supply to halogen-lamp heater 32, learning means (not shown) for learning the frequency of transmission of VDO signals based on PRINT signals supplied from external apparatus 28 via interface 27, temperature setting means (not shown) for changing stepwise the set temperature for temperature control processing for the halogen-lamp-heater driving circuitry in accordance with the frequency of transmission indicated by the result of learning of the learning means, and resetting means (not shown) for resetting the set temperature for the temperature control processing of the halogen-lamp-heater driving circuitry to a preset fixing temperature when a PRINT signal is supplied from external apparatus 28 while the temperature control processing of the halogen-lamp-heater driving circuitry stops.

The halogen-lamp-heater driving circuitry performs temperature control for fixing roller 9a by monitoring analog voltage $V_T$ corresponding to the surface temperature of fixing roller 9a and changing the level of output port OUT by MPU 36.

Static RAM 43 is connected to MPU 36 via external bus 41.

Next, a description will be provided of temperature control processing for fixing roller 9a with reference to FIG. 15.

When the main power supply is turned on (step 301), a warm-up mode is first executed. In the warm-up mode, halogen-lamp heater 32 is turned on (step 302), and heating of fixing roller 9a by halogen-lamp heater 32 is performed. When the surface temperature of fixing roller 9a has reached a standby temperature (step 303), a standby mode is executed (step 304).

In the standby mode, the measurement of duration of the standby mode is started by timer A (step 305). Thereafter standby temperature $T_s$ is set (step 306), and time $t_b$ used when reducing stepwise the surface temperature of fixing roller 9a is set in timer B (step 307). By controlling current supply to halogen-lamp heater 32 (steps 311 and 312) while monitoring the time measured by timer B (step 308), monitoring the reception of a PRINT signal (step 309), and monitoring the surface temperature of fixing roller 9a (step 310), the surface temperature of fixing roller 9a is maintained at the set standby temperature $T_s$.

If the time measured by timer B reaches time $t_b$ (step 308), standby temperature $T_s$ is changed to a lower temperature, and the changed temperature is set as standby temperature $T_s$ (step 313). Thereafter time $t_b$ is set again in timer B. If the time measured by timer B reaches time $t_b$, standby temperature $T_s$ is changed to a further lower temperature.

Standby temperature $T_s$ is changed until a PRINT signal is received. When a PRINT signal has been received (step 309), the measurement of time by timer A is stopped, and time $t_{sn}$ measured by timer A is stored in static RAM (step 314). Thereafter halogen-lamp heater 32 is turned on (step 315). If the surface temperature of fixing roller 9a is less than standby temperature $T_{sc}$ (step 316), heating by halogen-lamp heater 32 is continued until the surface temperature of fixing roller 9a reaches at least standby temperature $T_{sc}$.

If the surface temperature of fixing roller 9a equals at least standby temperature $T_{sc}$ (step 316), an image corresponding to an original image is formed on recording paper S (step 317). While the image formation is further continued (step 318), the surface temperature of fixing roller 9a is maintained at the fixing temperature (steps 319 through 321).

After the completion of the image formation, the mode is switched again to a standby mode (step 304).

Next, a description will be provided of the method of determining time $t_b$ to be set in timer B with reference to FIG. 16.

First, average value $t_a$ of standby times is obtained from n sampled standby times $t_{sm}$ (m=1, . . . , n) using the following expression (2):

$$t_a=(t_{s1}+t_{s2}+\ldots+t_{sn})/n \quad (2).$$

By dividing average value $t_a$ by m, time $t_b$ is determined using the following expression (3):

$$t_b=t_a/m \quad (3).$$

Temperature $\Delta T$ to be lowered for every lapse of time $t_b$ is then determined.

After the completion of the first image forming operation, the mode is switched from the printing mode to the standby mode. In the standby mode, when the duration of temperature control processing is time $t_b$ with the first standby temperature $T_{s0}$, temperature $T_{s1}$ ($=T_{s0}-\Delta T$) is used as standby temperature $T_s$ for the next temperature control processing, and the duration of the temperature control processing equals time $t_b$. Standby temperature $T_s$ is lowered by an amount $\Delta T$ at every lapse of time $T_b$. When standby temperature $T_s$ equals the ambient temperature, halogen-lamp heater 32 is turned off.

As described above, standby temperature $T_s$ for the temperature control processing by the halogen-lamp-heater driving circuitry is lowered stepwise in accordance with the result of learning for the frequency of transmission of PRINT signals from external apparatus 28. Hence, the amount of electric power consumed by halogen-lamp heater 32 can be reduced, while the time needed for raising the surface temperature of fixing roller 9a to the fixing temperature does not increase.

Figure 17:
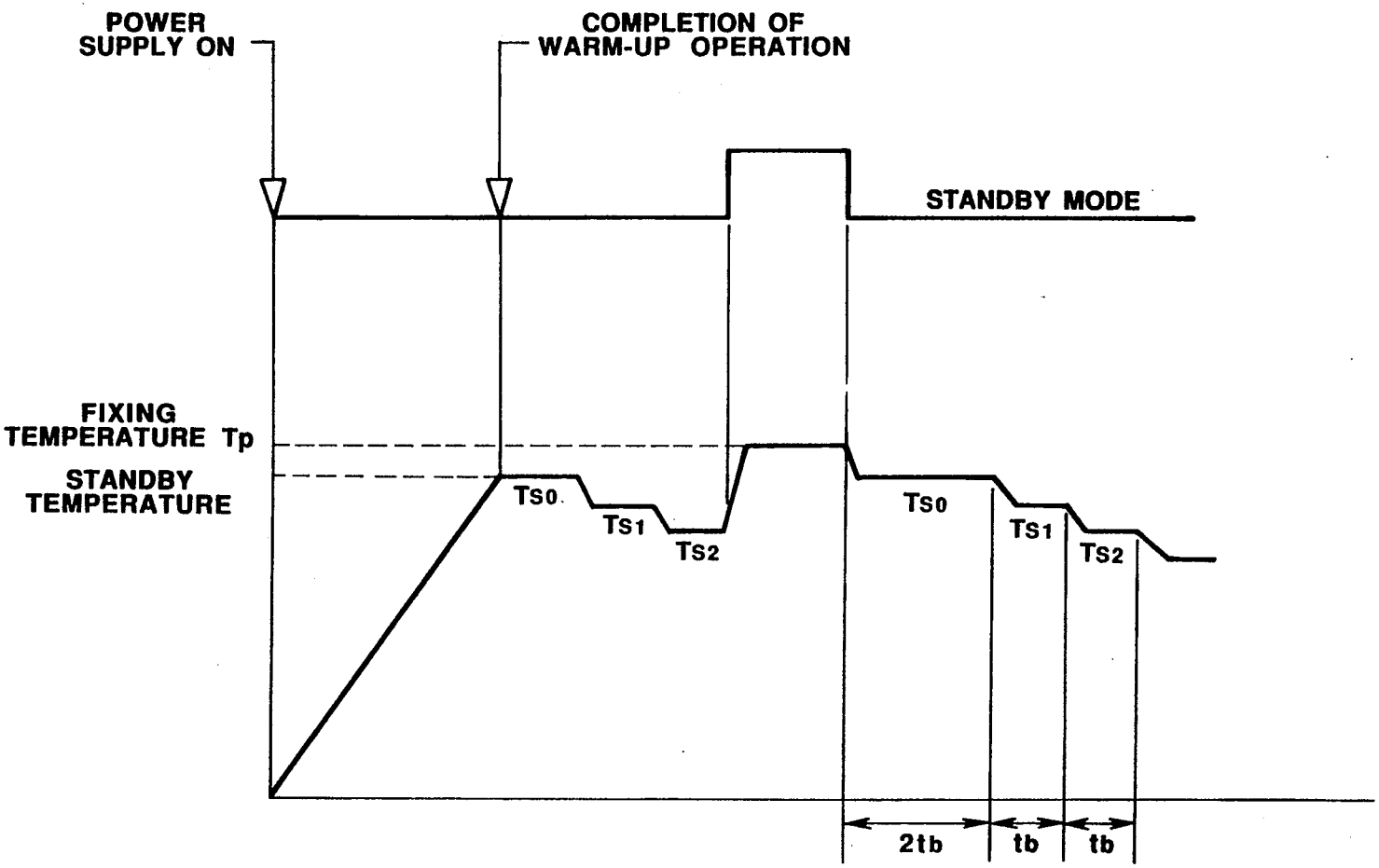
FIG. 17 is a time chart illustrating changes in the surface temperature of the fixing roller of the image forming apparatus shown in FIG. 14 according to another temperature processing.

Although, in the present embodiment, set time $t_b$ for timer B for lowering stepwise the surface temperature of fixing roller 9a is obtained by dividing average value $t_a$ by m, set time $t_b$ may be determined by unequally dividing average value $t_a$. For example, as shown in FIG. 17, since the probability of receiving a PRINT signal is high immediately after the mode has shifted to the standby mode, the set time for timer B immediately after the shift to the standby mode may be set to a value twice the set time $t_b$ in other cases. Thus, the surface temperature of the fixing roller is not lowered, and it is thereby possible to prepare for the next image forming operation.

Although, in the present embodiment, standby times in the past are measured and the method of reducing stepwise the standby temperature is determined by self learning of obtaining average value $t_a$ of sampled standby times, the method of calculating average value $t_a$ from initially set default values without performing self learning may also be adopted.

Alternatively, a switch for selecting whether or not self learning is to be performed may be provided so that the user may select the execution of self learning.

Figure 18:
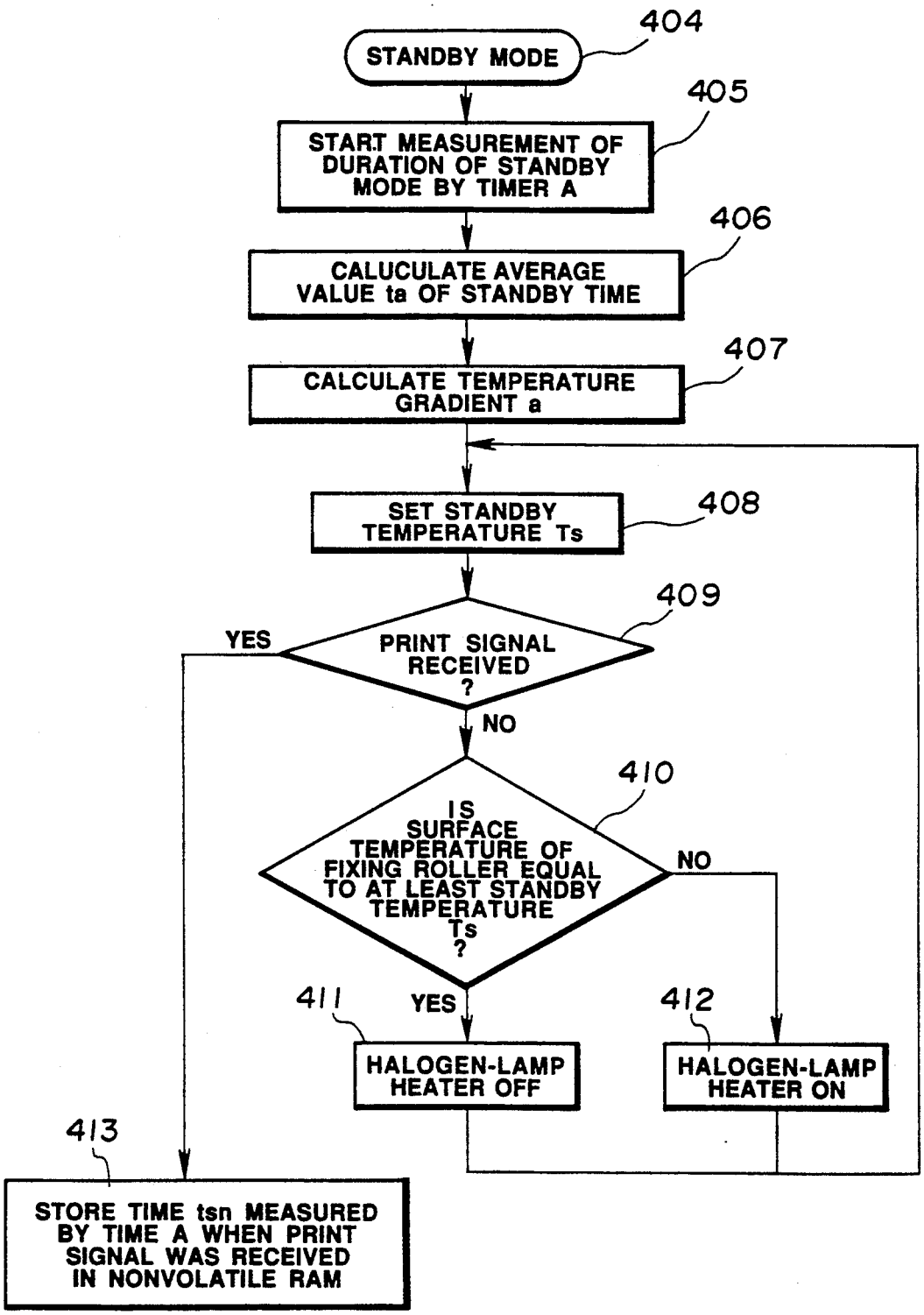
FIG 18 is a flowchart illustrating temperature control processing for a fixing roller of an image forming apparatus according to still another embodiment of the present invention.

Next, a description will be provided of an image forming apparatus according to still another embodiment of the present invention with reference to FIG. 18. FIG. 18 is a flowchart illustrating temperature control processing for a fixing roller of the image forming apparatus of the present embodiment.

First, temperature control processing for the fixing roller will be described with reference to FIG. 18.

When the main power supply is turned on, a warm-up mode is first executed. In the warm-up mode, a halogen-lamp heater is turned on, and heating of the fixing roller by the halogen-lamp heater is performed. When the surface temperature of the fixing roller has reached a standby temperature, a standby mode is executed (step 404).

In the standby mode, the measurement of duration of the standby mode is started by timer A (step 405). Thereafter average value $t_a$ of standby times in the past is obtained (step 406), and temperature gradient "a" is obtained.

Average value $t_a$ is obtained by the above-described expression (2). Temperature gradient "a" is obtained using the following expression (4):

$$a=\Delta T_a/t_a \quad (4),$$

where $\Delta T_a$ represents the amount of the surface temperature of the fixing roller to be lowered for average value $t_a$ of standby times.

Standby temperature $T_s$ is then obtained using the following expression (5), and the obtained standby temperature $T_s$ is set as the control temperature (step 408):

$$T_s=T_{s0}-a\times t_s \quad (5),$$

where $T_{s0}$ is the initial value of the standby temperature and standby time $t_s$ is the time elapsed during the standby mode after the start of timer A.

By controlling current supply to the halogen-lamp heater (steps 411 and 412) while monitoring the reception of a PRINT signal (step 409), and monitoring the surface temperature of the fixing roller (step 410), the surface temperature of the fixing roller is maintained at the set standby temperature $T_s$.

Standby temperature $T_s$ is changed until a PRINT signal is received. When a PRINT signal has been received (step 409), the measurement of standby time by timer A is stopped, and sampled standby time $t_{sn}$ measured by timer A is stored in a static RAM (step 413). Thereafter an image corresponding to the original image is formed on recording paper S.

As described above, standby temperature $T_s$ for the temperature control processing by the halogen-lamp-heater driving circuitry is lowered stepwise in accordance with the result of learning for the frequency of transmission of PRINT signals from external apparatus 28. Hence, the amount of electric power consumed by halogen-lamp heater 32 can be reduced, while the time needed for raising the surface temperature of fixing roller 9a to the fixing temperature does not increase.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus, comprising:

image forming means for forming a non-fixed image on a recording material;

heat fixing means for fixing the non-fixed image on the recording material by heating, said heat fixing means comprising a heating member heated by a heater, a temperature detection member for detecting a temperature of said heating member, and electric power-supply control means for controlling electric power supply to the heater so that the temperature detected by said temperature detection member is maintained at a predetermined control temperature in a standby state;

electric-power reduction means for reducing or shutting electric power supply to the heater when an image forming signal is not input for a predetermined time period after the completion of an image forming operation;

discriminating means for discriminating the frequency of image forming operations, wherein said electric power reduction means sets the predetermined time period variably in accordance with the frequency of image forming operations discriminated by said discriminating means.

2. An image forming apparatus according to claim 1, wherein said electric-power reduction means lowers the control temperature when an image forming signal is not input for the predetermined time period after the completion of the image forming operation.

3. An image forming apparatus according to claim 1, wherein said discriminating means comprises a timer for measuring time and a counter for counting the number of image forming operations.

4. An image forming apparatus according to claim 1, wherein said discriminating means comprises a memory for storing the frequency of image forming operations, wherein data stored in said memory is periodically updated.

5. An image forming apparatus according to claim 1, further comprising resuming means for resuming temperature control for said heating member for image formation when an image forming signal has been input in an electric-power reducing mode by said electric-power reduction means.

6. An image forming apparatus according to claim 1, wherein said electric-power reduction means increases the predetermined time period when the frequency of image forming operations determined by said discriminating means has a large value.

7. An image forming apparatus, comprising:

image forming means for forming a non-fixed image on a recording material;

heat fixing means for fixing the non-fixed image on the recording material by heating, said heating fixing means comprising a heating member heated by a heater, a temperature detection member for detecting a temperature of said heating member, and electric power-supply control means for controlling electric power supply to the heater so that the temperature detected by said temperature detection member is maintained at a predetermined control temperature in a standby state;

temperature control means for lowering the control temperature when an image forming signal is not input for a predetermined time period after the completion of an image forming operation;

discriminating means for discriminating the frequency of image forming operations, wherein said temperature control means determines the control temperature in accordance with the frequency of image forming operation discriminated by said discriminating means and reduces the rate of reduction of the control temperature when the frequency of image forming operations discriminated by said discriminating means has a large value.

8. An image forming apparatus according to claim 7, wherein said discriminating means comprises a timer for measuring time and a counter for counting the number of image forming operations.

9. An image forming apparatus according to claim 7, wherein said discriminating means comprises a memory for storing the frequency of image forming operations, wherein data stored in said memory is periodically updated.

10. An image forming apparatus according to claim 7, further comprising resuming means for resuming temperature control for image formation when an image forming signal has been input in a low-temperature control state by said temperature control means.

* * * * *

UNITED STATES PATENT AND TRADEMARK OFFICE

CERTIFICATE OF CORRECTION

PATENT NO. : 5,321,478

DATED : June 14, 1994

INVENTOR(S) : AKIHIRO NAKAMURA, ET AL.

It is certified that error appears in the above-identified patent and that said Letters Patent is hereby corrected as shown below:

ON TITLE PAGE

In [57] ABSTRACT, Line 19: "with" should read --with the--.

IN THE DRAWINGS

Sheet 12 of 18, "SHUFT-OFF" should read --SHUT-OFF--.
Sheet 18 of 18, "CALUCULATE" should read --CALCULATE--.

COLUMN 6

Line 32, "transmit" should read --transmits--.
Line 50, "registration" should read --registration-roller--.

COLUMN 7

Line 25, "temperature" should read --surface temperature--.

COLUMN 8

Line 25, "turned-Off" should read --turned-off--.

COLUMN 9

Line 31, "apparatus 28,." should read --apparatus 28.--.

COLUMN 13

Line 6, "time $T_b$." should read --time $t_b$.--.

--

UNITED STATES PATENT AND TRADEMARK OFFICE

CERTIFICATE OF CORRECTION

PATENT NO. : 5,321,478

DATED : June 14, 1994

INVENTOR(S) : AKIHIRO NAKAMURA, ET AL.

It is certified that error appears in the above-identified patent and that said Letters Patent is hereby corrected as shown below:

COLUMN 16

Line 14, "operation" should read --operations--.

Signed and Sealed this

Seventh Day of February, 1995

Bruce Lehman

*Attest:*

BRUCE LEHMAN

*Attesting Officer*

*Commissioner of Patents and Trademarks*